US006816135B2

(12) United States Patent
Ide et al.

(10) Patent No.: US 6,816,135 B2
(45) Date of Patent: Nov. 9, 2004

(54) PLASMA DISPLAY PANEL DRIVING METHOD AND PLASMA DISPLAY APPARATUS

(75) Inventors: Shigeo Ide, Nakakoma-gun (JP); Takashi Iwami, Nakakoma-gun (JP); Shiro Nagaoka, Fukuroi (JP); Mitsushi Kitagawa, Fukuroi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 369 days.

(21) Appl. No.: 10/162,642

(22) Filed: Jun. 6, 2002

(65) Prior Publication Data

US 2002/0186185 A1 Dec. 12, 2002

(30) Foreign Application Priority Data

Jun. 7, 2001 (JP) ..... 2001-172389

(51) Int. Cl.[7] ..... G09G 3/28; G09G 5/00; G09G 10/00; G09G 3/10

(52) U.S. Cl. ..... 345/60; 345/63; 345/66; 345/68; 345/211; 345/690; 315/169.4

(58) Field of Search ..... 345/60, 63, 66.68, 345/690–691, 204, 211; 315/169.4

(56) References Cited

U.S. PATENT DOCUMENTS 4,349,819 A * 9/1982 Terakawa ..... 345/211
5,943,032 A 8/1999 Nagaoka et al.
5,973,655 A * 10/1999 Fujisaki et al. ..... 345/63
6,037,917 A * 3/2000 Kawakami ..... 345/63
6,144,364 A 11/2000 Otobe et al.
6,175,194 B1 * 1/2001 Saegusa et al. ..... 315/169.4
6,400,346 B2 * 6/2002 Kasahara et al. ..... 345/63
6,417,824 B1 * 7/2002 Tokunaga et al. ..... 345/60
6,552,736 B2 * 4/2003 Honda et al. ..... 345/691
6,614,413 B2 * 9/2003 Tokunaga et al. ..... 345/63
6,724,356 B1 * 4/2004 Kojima et al. ..... 345/60

FOREIGN PATENT DOCUMENTS

| | | |
|---|---|---|
| EP | 0 847 037 A1 | 6/1998 |
| EP | 0 851 400 A1 | 7/1998 |
| EP | 0 952 569 A2 | 10/1999 |
| JP | 6-259034 | 9/1994 |
| WO | WO 99/30309 A1 | 6/1999 |

* cited by examiner

*Primary Examiner*—Regina Liang
*Assistant Examiner*—Duc Q. Dinh
(74) *Attorney, Agent, or Firm*—Sughrue Mion, PLLC

(57) ABSTRACT

A plasma display panel driving method and a plasma display apparatus which can reduce power consumption. A selective discharge is generated at least once for selectively setting each of discharge cells of a plasma display panel either to a lit discharge cell state or to an unlit discharge cell state in accordance with a video signal. In this case, the number of times the selective discharge is generated is changed in accordance with the power consumption associated with the selective discharge.

10 Claims, 11 Drawing Sheets

FIG. 4

(SELECTIVE ERASURE)

| GRADATION | CONVERSION TABLE FOR SECOND DATA CONVERTING CIRCUIT 34 | | | | | | | | | | | | | | | ONE FIELD LIGHT EMISSION DRIVING PATTERN | | | | | | | | | | | | | | LIGHT EMISSION LUMINANCE |
|---|---|---|---|---|---|---|---|---|---|---|---|---|---|---|---|---|---|---|---|---|---|---|---|---|---|---|---|---|---|---|
| | PDs | GDa | | | | | | | | | | | | | | SF | SF | SF | SF | SF | SF | SF | SF | SF | SF | SF | SF | SF | SF | |
| | | 1 | 2 | 3 | 4 | 5 | 6 | 7 | 8 | 9 | 10 | 11 | 12 | 13 | 14 | 1 | 2 | 3 | 4 | 5 | 6 | 7 | 8 | 9 | 10 | 11 | 12 | 13 | 14 | |
| 1 | 0000 | 1 | 1 | 1 | 1 | 1 | 1 | 1 | 1 | 1 | 1 | 1 | 1 | 1 | 1 | ● | ● | ● | ● | ● | ● | ● | ● | ● | ● | ● | ● | ● | ● | 0 |
| 2 | 0001 | 0 | 1 | 1 | 1 | 1 | 1 | 1 | 1 | 1 | 1 | 1 | 1 | 1 | 1 | ○ | ● | ● | ● | ● | ● | ● | ● | ● | ● | ● | ● | ● | ● | 4 |
| 3 | 0010 | 0 | 0 | 1 | 1 | 1 | 1 | 1 | 1 | 1 | 1 | 1 | 1 | 1 | 1 | ○ | ○ | ● | ● | ● | ● | ● | ● | ● | ● | ● | ● | ● | ● | 16 |
| 4 | 0011 | 0 | 0 | 0 | 1 | 1 | 1 | 1 | 1 | 1 | 1 | 1 | 1 | 1 | 1 | ○ | ○ | ○ | ● | ● | ● | ● | ● | ● | ● | ● | ● | ● | ● | 36 |
| 5 | 0100 | 0 | 0 | 0 | 0 | 1 | 1 | 1 | 1 | 1 | 1 | 1 | 1 | 1 | 1 | ○ | ○ | ○ | ○ | ● | ● | ● | ● | ● | ● | ● | ● | ● | ● | 68 |
| 6 | 0101 | 0 | 0 | 0 | 0 | 0 | 1 | 1 | 1 | 1 | 1 | 1 | 1 | 1 | 1 | ○ | ○ | ○ | ○ | ○ | ● | ● | ● | ● | ● | ● | ● | ● | ● | 108 |
| 7 | 0110 | 0 | 0 | 0 | 0 | 0 | 0 | 1 | 1 | 1 | 1 | 1 | 1 | 1 | 1 | ○ | ○ | ○ | ○ | ○ | ○ | ● | ● | ● | ● | ● | ● | ● | ● | 160 |
| 8 | 0111 | 0 | 0 | 0 | 0 | 0 | 0 | 0 | 1 | 1 | 1 | 1 | 1 | 1 | 1 | ○ | ○ | ○ | ○ | ○ | ○ | ○ | ● | ● | ● | ● | ● | ● | ● | 224 |
| 9 | 1000 | 0 | 0 | 0 | 0 | 0 | 0 | 0 | 0 | 1 | 1 | 1 | 1 | 1 | 1 | ○ | ○ | ○ | ○ | ○ | ○ | ○ | ○ | ● | ● | ● | ● | ● | ● | 300 |
| 10 | 1001 | 0 | 0 | 0 | 0 | 0 | 0 | 0 | 0 | 0 | 1 | 1 | 1 | 1 | 1 | ○ | ○ | ○ | ○ | ○ | ○ | ○ | ○ | ○ | ● | ● | ● | ● | ● | 388 |
| 11 | 1010 | 0 | 0 | 0 | 0 | 0 | 0 | 0 | 0 | 0 | 0 | 1 | 1 | 1 | 1 | ○ | ○ | ○ | ○ | ○ | ○ | ○ | ○ | ○ | ○ | ● | ● | ● | ● | 488 |
| 12 | 1011 | 0 | 0 | 0 | 0 | 0 | 0 | 0 | 0 | 0 | 0 | 0 | 1 | 1 | 1 | ○ | ○ | ○ | ○ | ○ | ○ | ○ | ○ | ○ | ○ | ○ | ● | ● | ● | 600 |
| 13 | 1100 | 0 | 0 | 0 | 0 | 0 | 0 | 0 | 0 | 0 | 0 | 0 | 0 | 1 | 1 | ○ | ○ | ○ | ○ | ○ | ○ | ○ | ○ | ○ | ○ | ○ | ○ | ● | ● | 728 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 868 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 1024 |

●: SELECTIVE ERASURE DISCHARGE
○: LIGHT EMISSION BY SUSTAIN DISCHARGE

FIG. 5

(SELECTIVE ERASURE)

| GRADATION | CONVERSION TABLE FOR SECOND DATA CONVERTING CIRCUIT 35 | | | | | | | | | | | | | | | ONE FIELD LIGHT EMISSION DRIVING PATTERN | | | | | | | | | | | | | | LIGHT EMISSION LUMINANCE |
|---|---|---|---|---|---|---|---|---|---|---|---|---|---|---|---|---|---|---|---|---|---|---|---|---|---|---|---|---|---|---|
| | PDs | GDb | | | | | | | | | | | | | | SF | SF | SF | SF | SF | SF | SF | SF | SF | SF | SF | SF | SF | SF | |
| | | 1 | 2 | 3 | 4 | 5 | 6 | 7 | 8 | 9 | 10 | 11 | 12 | 13 | 14 | 1 | 2 | 3 | 4 | 5 | 6 | 7 | 8 | 9 | 10 | 11 | 12 | 13 | 14 | |
| 1 | 0000 | 1 | 0 | 0 | 0 | 0 | 0 | 0 | 0 | 0 | 0 | 0 | 0 | 0 | 0 | ● | | | | | | | | | | | | | | 0 |
| 2 | 0001 | 0 | 1 | 0 | 0 | 0 | 0 | 0 | 0 | 0 | 0 | 0 | 0 | 0 | 0 | ○ | ● | | | | | | | | | | | | | 4 |
| 3 | 0010 | 0 | 0 | 1 | 0 | 0 | 0 | 0 | 0 | 0 | 0 | 0 | 0 | 0 | 0 | ○ | ○ | ● | | | | | | | | | | | | 16 |
| 4 | 0011 | 0 | 0 | 0 | 1 | 0 | 0 | 0 | 0 | 0 | 0 | 0 | 0 | 0 | 0 | ○ | ○ | ○ | ● | | | | | | | | | | | 36 |
| 5 | 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 68 |
| 6 | 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 108 |
| 7 | 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 160 |
| 8 | 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 224 |
| 9 | 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 300 |
| 10 | 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 388 |
| 11 | 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 488 |
| 12 | 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 600 |
| 13 | 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 728 |
| 14 | 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 868 |
| 15 | 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 1024 |

●: SELECTIVE ERASURE DISCHARGE
○: LIGHT EMISSION BY SUSTAIN DISCHARGE

FIG. 9

(SELECTIVE WRITE)

| GRADATION | CONVERSION TABLE FOR SECOND DATA CONVERTING CIRCUIT 34 | | | | | | | | | | | | | | | ONE FIELD LIGHT EMISSION DRIVING PATTERN | | | | | | | | | | | | | | LIGHT EMISSION LUMINANCE |
|---|---|---|---|---|---|---|---|---|---|---|---|---|---|---|---|---|---|---|---|---|---|---|---|---|---|---|---|---|---|---|
| | PDs | GDa | | | | | | | | | | | | | | SF 14 | SF 13 | SF 12 | SF 11 | SF 10 | SF 9 | SF 8 | SF 7 | SF 6 | SF 5 | SF 4 | SF 3 | SF 2 | SF 1 | |
| | | 14 | 13 | 12 | 11 | 10 | 9 | 8 | 7 | 6 | 5 | 4 | 3 | 2 | 1 | | | | | | | | | | | | | | | |
| 1 | 0000 | 0 | 0 | 0 | 0 | 0 | 0 | 0 | 0 | 0 | 0 | 0 | 0 | 0 | 0 | | | | | | | | | | | | | | | 0 |
| 2 | 0001 | 0 | 0 | 0 | 0 | 0 | 0 | 0 | 0 | 0 | 0 | 0 | 0 | 0 | 1 | | | | | | | | | | | | | | △ | 4 |
| 3 | 0010 | 0 | 0 | 0 | 0 | 0 | 0 | 0 | 0 | 0 | 0 | 0 | 0 | 1 | 1 | | | | | | | | | | | | | △ | △ | 16 |
| 4 | 0011 | 0 | 0 | 0 | 0 | 0 | 0 | 0 | 0 | 0 | 0 | 0 | 1 | 1 | 1 | | | | | | | | | | | | △ | △ | △ | 36 |
| 5 | 0100 | 0 | 0 | 0 | 0 | 0 | 0 | 0 | 0 | 0 | 0 | 1 | 1 | 1 | 1 | | | | | | | | | | | △ | △ | △ | △ | 68 |
| 6 | 0101 | 0 | 0 | 0 | 0 | 0 | 0 | 0 | 0 | 0 | 1 | 1 | 1 | 1 | 1 | | | | | | | | | | △ | △ | △ | △ | △ | 108 |
| 7 | 0110 | 0 | 0 | 0 | 0 | 0 | 0 | 0 | 0 | 1 | 1 | 1 | 1 | 1 | 1 | | | | | | | | | △ | △ | △ | △ | △ | △ | 160 |
| 8 | 0111 | 0 | 0 | 0 | 0 | 0 | 0 | 0 | 1 | 1 | 1 | 1 | 1 | 1 | 1 | | | | | | | | △ | △ | △ | △ | △ | △ | △ | 224 |
| 9 | 1000 | 0 | 0 | 0 | 0 | 0 | 0 | 1 | 1 | 1 | 1 | 1 | 1 | 1 | 1 | | | | | | | △ | △ | △ | △ | △ | △ | △ | △ | 300 |
| 10 | 1001 | 0 | 0 | 0 | 0 | 0 | 1 | 1 | 1 | 1 | 1 | 1 | 1 | 1 | 1 | | | | | | △ | △ | △ | △ | △ | △ | △ | △ | △ | 388 |
| 11 | 1010 | 0 | 0 | 0 | 0 | 1 | 1 | 1 | 1 | 1 | 1 | 1 | 1 | 1 | 1 | | | | | △ | △ | △ | △ | △ | △ | △ | △ | △ | △ | 488 |
| 12 | 1011 | 0 | 0 | 0 | 1 | 1 | 1 | 1 | 1 | 1 | 1 | 1 | 1 | 1 | 1 | | | | △ | △ | △ | △ | △ | △ | △ | △ | △ | △ | △ | 600 |
| 13 | 1100 | 0 | 0 | 1 | 1 | 1 | 1 | 1 | 1 | 1 | 1 | 1 | 1 | 1 | 1 | | | △ | △ | △ | △ | △ | △ | △ | △ | △ | △ | △ | △ | 728 |
| 14 | 1101 | 0 | 1 | 1 | 1 | 1 | 1 | 1 | 1 | 1 | 1 | 1 | 1 | 1 | 1 | | △ | △ | △ | △ | △ | △ | △ | △ | △ | △ | △ | △ | △ | 868 |
| 15 | 1110 | 1 | 1 | 1 | 1 | 1 | 1 | 1 | 1 | 1 | 1 | 1 | 1 | 1 | 1 | △ | △ | △ | △ | △ | △ | △ | △ | △ | △ | △ | △ | △ | △ | 1024 |

△: SELECTIVE WRITE DISCHARGE
+ LIGHT EMISSION BY SUSTAIN DISCHARGE

FIG. 10

(SELECTIVE WRITE)

| GRADATION | CONVERSION TABLE FOR SECOND DATA CONVERTING CIRCUIT 35 | | | | | | | | | | | | | | | ONE FIELD LIGHT EMISSION DRIVING PATTERN | | | | | | | | | | | | | | LIGHT-EMISSION LUMINANCE |
|---|---|---|---|---|---|---|---|---|---|---|---|---|---|---|---|---|---|---|---|---|---|---|---|---|---|---|---|---|---|---|
| | PDs | GDb | | | | | | | | | | | | | | SF | SF | SF | SF | SF | SF | SF | SF | SF | SF | SF | SF | SF | SF | |
| | | 14 | 13 | 12 | 11 | 10 | 9 | 8 | 7 | 6 | 5 | 4 | 3 | 2 | 1 | 14 | 13 | 12 | 11 | 10 | 9 | 8 | 7 | 6 | 5 | 4 | 3 | 2 | 1 | |
| 1 | 0000 | 0 | 0 | 0 | 0 | 0 | 0 | 0 | 0 | 0 | 0 | 0 | 0 | 0 | 0 | | | | | | | | | | | | | | | 0 |
| 2 | 0001 | 0 | 0 | 0 | 0 | 0 | 0 | 0 | 0 | 0 | 0 | 0 | 0 | 0 | 1 | | | | | | | | | | | | | | ● | 4 |
| 3 | 0010 | 0 | 0 | 0 | 0 | 0 | 0 | 0 | 0 | 0 | 0 | 0 | 0 | 1 | 0 | | | | | | | | | | | | | ● | ○ | 16 |
| 4 | 0011 | 0 | 0 | 0 | 0 | 0 | 0 | 0 | 0 | 0 | 0 | 0 | 1 | 0 | 0 | | | | | | | | | | | | ● | ○ | ○ | 36 |
| 5 | 0100 | 0 | 0 | 0 | 0 | 0 | 0 | 0 | 0 | 0 | 0 | 1 | 0 | 0 | 0 | | | | | | | | | | | ● | ○ | ○ | ○ | 68 |
| 6 | 0101 | 0 | 0 | 0 | 0 | 0 | 0 | 0 | 0 | 0 | 1 | 0 | 0 | 0 | 0 | | | | | | | | | | ● | ○ | ○ | ○ | ○ | 108 |
| 7 | 0110 | 0 | 0 | 0 | 0 | 0 | 0 | 0 | 0 | 1 | 0 | 0 | 0 | 0 | 0 | | | | | | | | | ● | ○ | ○ | ○ | ○ | ○ | 160 |
| 8 | 0111 | 0 | 0 | 0 | 0 | 0 | 0 | 0 | 1 | 0 | 0 | 0 | 0 | 0 | 0 | | | | | | | | ● | ○ | ○ | ○ | ○ | ○ | ○ | 224 |
| 9 | 1000 | 0 | 0 | 0 | 0 | 0 | 0 | 1 | 0 | 0 | 0 | 0 | 0 | 0 | 0 | | | | | | | ● | ○ | ○ | ○ | ○ | ○ | ○ | ○ | 300 |
| 10 | 1001 | 0 | 0 | 0 | 0 | 0 | 1 | 0 | 0 | 0 | 0 | 0 | 0 | 0 | 0 | | | | | | ● | ○ | ○ | ○ | ○ | ○ | ○ | ○ | ○ | 388 |
| 11 | 1010 | 0 | 0 | 0 | 0 | 1 | 0 | 0 | 0 | 0 | 0 | 0 | 0 | 0 | 0 | | | | | ● | ○ | ○ | ○ | ○ | ○ | ○ | ○ | ○ | ○ | 488 |
| 12 | 1011 | 0 | 0 | 0 | 1 | 0 | 0 | 0 | 0 | 0 | 0 | 0 | 0 | 0 | 0 | | | | ● | ○ | ○ | ○ | ○ | ○ | ○ | ○ | ○ | ○ | ○ | 600 |
| 13 | 1100 | 0 | 0 | 1 | 0 | 0 | 0 | 0 | 0 | 0 | 0 | 0 | 0 | 0 | 0 | | | ● | ○ | ○ | ○ | ○ | ○ | ○ | ○ | ○ | ○ | ○ | ○ | 728 |
| 14 | 1101 | 0 | 1 | 0 | 0 | 0 | 0 | 0 | 0 | 0 | 0 | 0 | 0 | 0 | 0 | | ● | ○ | ○ | ○ | ○ | ○ | ○ | ○ | ○ | ○ | ○ | ○ | ○ | 868 |
| 15 | 1110 | 1 | 0 | 0 | 0 | 0 | 0 | 0 | 0 | 0 | 0 | 0 | 0 | 0 | 0 | ● | ○ | ○ | ○ | ○ | ○ | ○ | ○ | ○ | ○ | ○ | ○ | ○ | ○ | 1024 |

●: SELECTIVE WRITE DISCHARGE + LIGHT EMISSION BY SUSTAIN DISCHARGE

○: LIGHT EMISSION BY SUSTAIN DISCHARGE

PLASMA DISPLAY PANEL DRIVING METHOD AND PLASMA DISPLAY APPARATUS

BACKGROUND OF THE INVENTION

1. Field of the Invention

The present invention relates to a method of driving a plasma display panel in accordance with a matrix display scheme, and a plasma display apparatus.

2. Description of the Related Art

In recent years, a variety of thin display devices have been brought into practical use in response to demands for thinner display devices with the trend of an increase in screen sizes thereof. A plasma display panel (hereinafter referred to as the "PDP") has drawn attention as one of thin display devices, which comprises a plurality of discharge cells arranged in matrix for carrying pixels. In this plasma display panel, since each discharge cell emits light by discharging, it can represent only two levels of luminance, i.e., a "lit state" in which the discharge cell emits light at a predetermined luminance, and an "unlit state." Thus, a subfield method is employed to implement gradation driving for providing halftone display luminance levels corresponding to an input video signal for a PDP comprised of the discharge cells as described above.

The subfield method involves dividing one field display period into N subfields, and allocating to each of the N subfields a number of times discharge cells are continuously discharged. Each subfield includes an addressing stage which is executed to selectively discharge each of discharge cells in accordance with an input video signal to set the discharge cell in either a "lit discharge cell state" or an "unlit discharge cell state," and a light emission sustain stage which is executed to repeatedly discharge only discharge cells in the "lit discharge cell state" the allocated number of times to emit light. According to this driving method, an intermediate luminance is represented in accordance with a total number of discharges performed for emitting light in each light emission sustain stage within one field display period.

In the plasma display apparatus, the discharge cells are discharged not only in the light emission sustain stage for actually displaying an image but also in the addressing stage, so that the discharge cells consume the power in accordance with currents which flow associated with the discharges. In this case, whether each discharge cell discharges or not in the addressing stage depends on an input video signal. Therefore, depending on an input video signal which specifies an image to be displayed, a problem arises in that the power consumed in the addressing step is increased.

OBJECT AND SUMMARY OF THE INVENTION

The present invention has been made to solve the problem mentioned above, and it is an object of the invention to provide a plasma display panel driving method and a plasma display apparatus which are capable of saving the power consumption.

A plasma display panel driving method according to the present invention is provided for driving a plasma display panel including a plurality of discharge cells carrying display pixels based on a video signal. The method includes an addressing stage for generating a selective discharge at least once for setting each of the discharge cells to a lit discharge cell state or an unlit discharge cell state in accordance with pixel data based on the video signal, and a light emission sustain stage for causing only the discharge cell in the lit discharge cell state to repeatedly discharge, wherein the number of times of the selective discharges generated in the addressing stage is changed in accordance with power consumption associated with the selective discharge.

In addition, a plasma display apparatus according to the present invention has a plurality of row electrode pairs corresponding to display lines and a plurality of column electrodes arranged to intersect with each of the row electrode pairs, and discharge cells each formed at each of intersections of the row electrode pairs and the column electrodes for carrying a pixel, wherein one field display period includes N subfields each comprised of an addressing period and a light emission sustain period for driving the plasma display panel. The plasma display apparatus includes an address driver for generating a pixel data pulse for selectively discharging the discharge cells in the addressing period of one subfield in the N subfields and each of subfields subsequent to the one subfield and consecutive to each other to set the discharge cell to a lit discharge cell state or an unlit discharge cell stage, and applying the pixel data pulse to the column electrodes, a sustain driver for repeatedly applying a sustain pulse to the row electrodes in the light emission sustain period in each of the subfields to repeatedly discharge only the discharge cells set in the lit discharge state to sustain light emission, address driver power measuring part for measuring power consumed by the address driver, and address power control part for changing the number of times the selective discharge is generated in a subfield subsequent to the one subfield in accordance with the power consumption.

BRIEF DESCRIPTION OF THE DRAWINGS

FIG. 4 is a diagram showing a conversion table in a second data converting circuit 34, and an exemplary driving pattern performed based on pixel driving data $GD_a$ converted by the conversion table;

FIG. 5 is a diagram showing a conversion table in a second data converting circuit 35, and an exemplary driving pattern performed based on pixel driving data $GD_b$ converted by the conversion table;

FIG. 9 is a diagram showing a conversion table for the second data converting circuit 34 for use in driving the PDP 10 when employing the selective write addressing method, and an exemplary driving pattern performed based on pixel driving data $GD_a$ converted by the conversion table;

FIG. 10 is a diagram showing a conversion table for the second data converting circuit 35 for use in driving the PDP 10 when employing the selective write addressing method, and an exemplary driving pattern performed based on pixel driving data $GD_b$ converted by the conversion table.

DETAILED DESCRIPTION OF THE PREFERRED EMBODIMENTS

In the following, embodiments of the present invention will be described with reference to the drawings.

Figure 1:
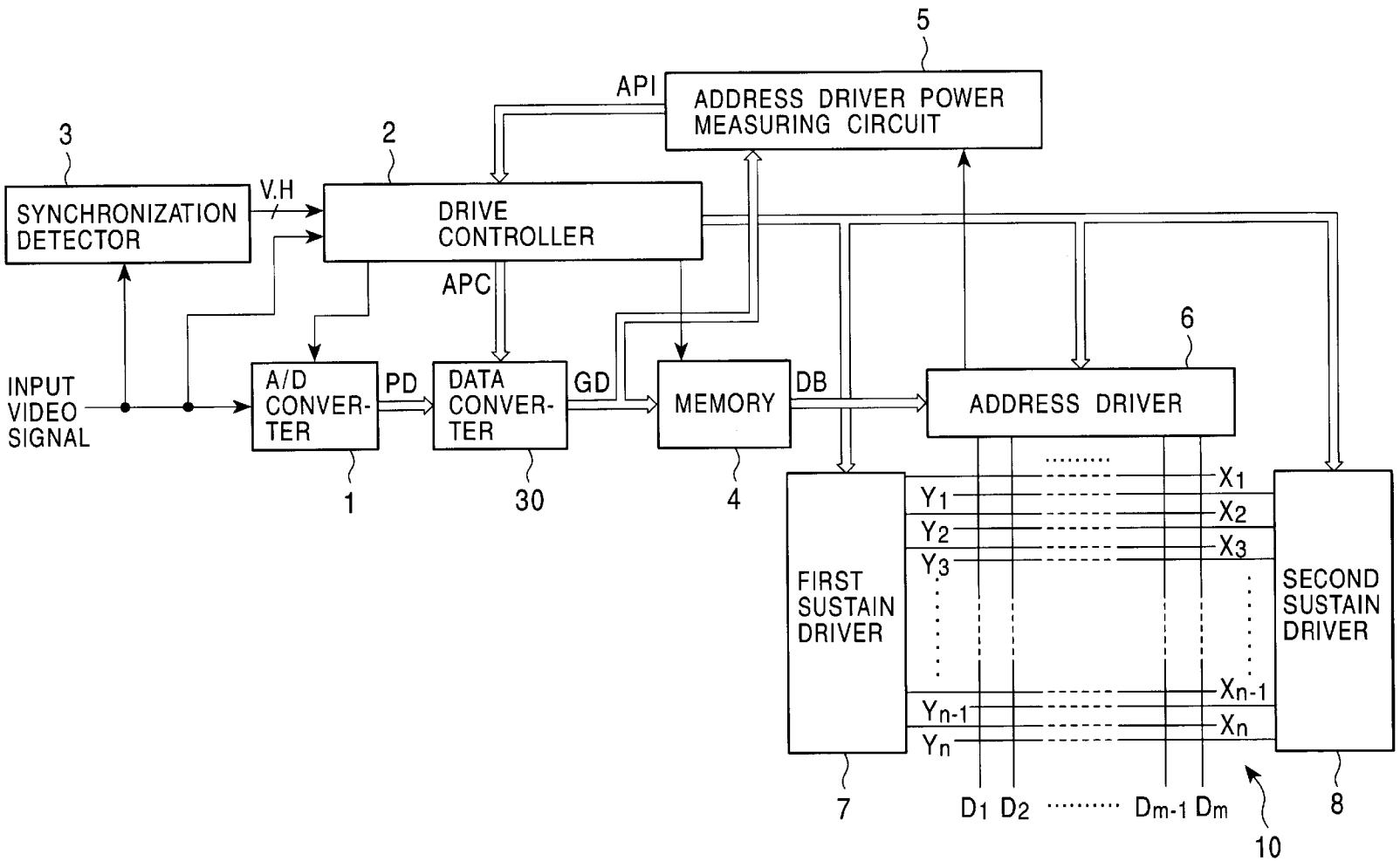
FIG. 1 is a block diagram generally illustrating the configuration of a plasma display apparatus for driving a plasma display panel based on a driving method according to the present invention.

FIG. 1 a block diagram generally illustrating the configuration of a plasma display apparatus for driving a plasma display panel based on a driving method according to the present invention.

This plasma display apparatus comprises a PDP 10 as a plasma display panel; and a driving unit comprised of an A/D converter 1, a drive control circuit 2, a synchronization detector circuit 3, a memory 4, an address driver power measuring circuit 5, an address driver 6, a first sustain driver 7, and a second sustain driver 8.

The PDP 10 comprises m column electrodes $D_1$–$D_m$ as address electrodes, and n row electrodes $X_1$–$X_n$ and row electrodes $Y_1$–$Y_n$ which are arranged to intersect each of the column electrodes. In this structure, a pair of a row electrode X and a row electrode Y form a row electrode corresponding to one line in the PDP 10. The column electrode D and the low electrode pair X, Y are covered with a dielectric layer defining a discharge space, and a discharge cell carrying one pixel is formed at an intersection of each row electrode pair with each column electrode.

The A/D converter 1 samples an input analog input video signal in response to a clock signal supplied from the drive control circuit 2, and converts the sampled input video signal to, for example, 8-bit pixel data PD. The data cconverter 30 converts the 8-bit pixel data PD to 14-bit pixel driving data GD.

Figure 2:
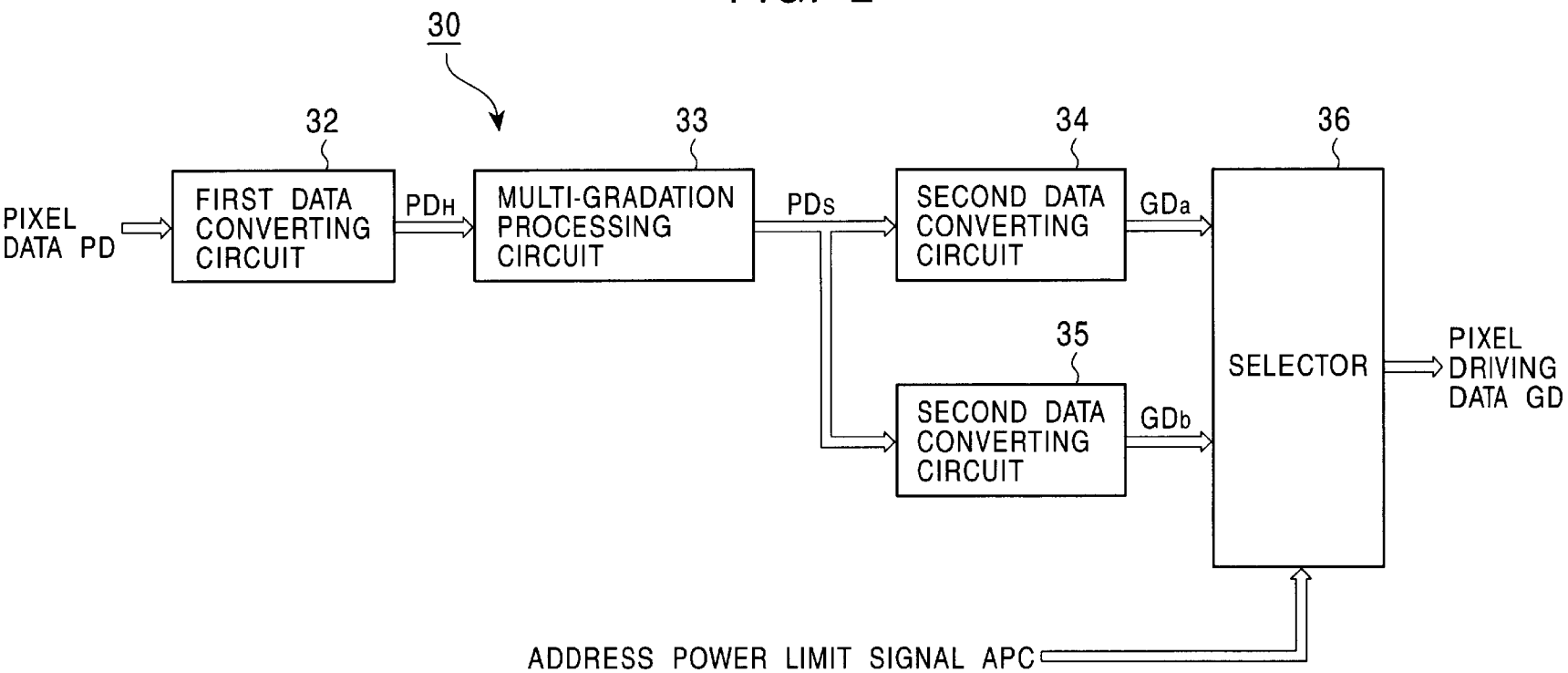
FIG. 2 is a block diagram illustrating an exemplary internal configuration of a data converter 30 in the plasma display apparatus illustrated in FIG. 1.

FIG. 2 is a block diagram illustrating the internal configuration of the data cconverter 30.

Figure 3:
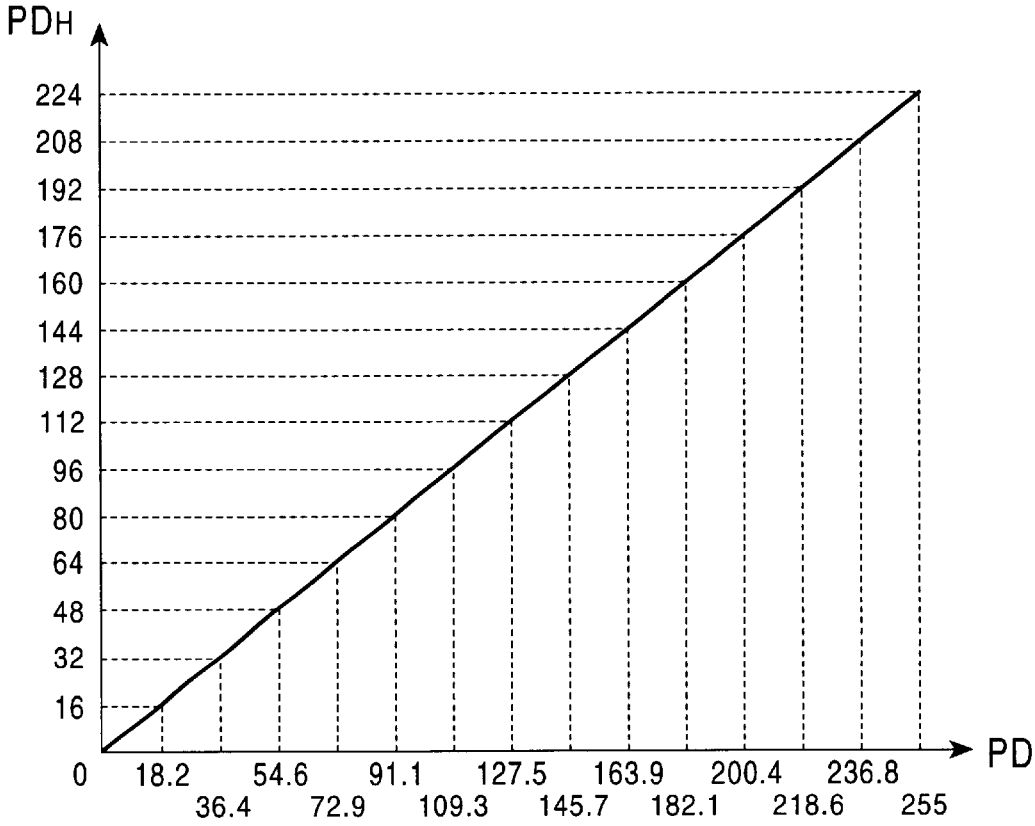
FIG. 3 is a graph showing a data conversion characteristic in a first data converting circuit 32 illustrated in FIG. 2.

In FIG. 2, a first data converting circuit 32 converts the 8-bit pixel data PD sequentially supplied from the A/D converter 1 to 8-bit converted pixel data $PD_H$ pruned by (14/16)/255, i.e., 224/255 based on a conversion characteristic as shown in FIG. 3, and supplies the 8-bit converted pixel data $PD_H$ to a multi-gradation processing circuit 33. The conversion characteristic is set in accordance with the number of compressed bits by multi-gradation processing in the multi-gradation processing circuit 33, and the number of displayed gradation levels. The data conversion by the first data converting circuit 32 prevents a saturated luminance in the multi-gradation processing circuit 33, later described, and a flat portion (i.e., distortion in gradation) in the display characteristic which would otherwise occur when a display gradation is not on a bit boundary.

The multi-gradation processing circuit 33 applies multi-gradation processing such as error diffusion processing, dither processing and so on to the converted pixel data $PD_H$. In this way, the multi-gradation processing circuit 33 generates multi-gradation pixel data $PD_S$ which has its number of bits compressed to four bits while substantially maintaining the number of gradation representation levels of visually perceived luminance to 256 gradation levels. For example, in the error diffusion processing, the converted pixel data $PD_H$ is separated into upper six bits as display data and the remaining lower two bits as error data. Then, the error data derived from the converted pixel data $PD_H$ corresponding to respective peripheral pixels are added with weighting. The resulting data is reflected to the display data. This operation causes the luminance of the lower two bits in the original pixel to be virtually represented by the peripheral pixel, so that a luminance gradation representation equivalent to the 8-bit pixel data can be provided by display data comprised of six bits which are less than eight bits. Next, the 6-bit error diffusion processed pixel data resulting from the error diffusion processing is applied with the dither processing. The dither processing involves treating a plurality of adjacent pixels as one pixel unit, and allocating dither coefficients having coefficient values different from one another to pixel data corresponding to the respective pixels in this pixel unit, and adding the resulting pixel data to derive dither addition pixel data. According to the dither addition as mentioned, even with only the upper four bits of the dither addition pixel data, a luminance corresponding to eight bits can be represented when viewed in the pixel unit. The multi-gradation processing circuit 33 extracts upper four bits of the dither addition pixel data as multi-gradation pixel data $PD_S$ which is supplied to each of second data converting circuits 34, 35.

The second data converting circuit 34 converts the 4-bit multi-gradation pixel data $PD_S$ to 14-bit pixel driving data $GD_a$ in accordance with a conversion table as shown in FIG. 4, and supplies the drive pixel data $GD_a$ to a selector 36. The second data converting circuit 35 converts the 4-bit multi-gradation pixel data $PD_S$ to 14-bit pixel driving data $GD_b$ in accordance with a conversion table as shown in FIG. 5, and supplies the pixel driving data $GD_b$ to the selector 36.

The selector 36 selects the pixel driving data $GD_a$ from the pixel driving data $GD_a$ and $GD_b$ when it is supplied with an address power limit signal APC at logical level "0" and supplies the selected pixel driving data $GD_a$ to the memory 4 as pixel driving data GD. On the other hand, the selector 36 selects pixel driving data $GD_b$ when it is supplied with the address power limit signal APC at logical level "1" and supplies the selected pixel driving data $GD_b$ to the memory 4 as pixel driving data GD.

The memory 4 sequentially stores the drive pixel data GD in response to a write signal supplied from the drive control circuit 2. Here, as the writing has been completed for one screen (n lines, m columns), the memory 4 reads the written data in response to a read signal supplied from the drive control circuit 2 in the following manner. Specifically, the memory 4 regards respective pixel driving data $GD_{11}$–$GD_{nm}$ of one screen written therein as pixel driving data bit groups DB1–DB14 which are grouped for every bit digit (first bit to fourteenth bit), reads one display line of the pixel driving data bit groups, and supplies the read data bits to the address driver 6.

Each of pixel driving data DB1–DB14 are as follows:

DB1: first bits of respective $GD_{11}$–$GD_{nm}$;
DB2: second bits of respective $GD_{11}$–$GD_{nm}$;
DB3: third bits of respective $GD_{11}$–$GD_{nm}$;
DB4: fourth bits of respective $GD_{11}$–$GD_{nm}$;
DB5: fifth bits of respective $GD_{11}$–$GD_{nm}$;
DB6: sixth bits of respective $GD_{11}$–$GD_{nm}$;
DB7: seventh bits of respective $GD_{11}$–$GD_{nm}$;
DB8: eighth bits of respective $GD_{11}$–$GD_{nm}$;
DB9: ninth bits of respective $GD_{11}$–$GD_{nm}$;
DB10: tenth bits of respective $GD_{11}$–$GD_{nm}$;
DB11: eleventh bits of respective $GD_{11}$–$GD_{nm}$;

DB12: twelfth bits of respective $GD_{11}$–$GD_{nm}$;

DB13: thirteenth bits of respective $GD_{11}$–$GD_{nm}$;

DB14: fourteenth bits of respective $GD_{11}$–$GD_{nm}$;

The address driver power measuring circuit 5 detects a current flowing on a power supply line (not shown) of an internal power supply circuit in the address driver 6, and measures the power consumption of the address driver 6 based on the amount of current. Then, the address driver power measuring circuit 5 supplies the drive control circuit 2 with an address power information signal API indicative of the measured power consumption. Alternatively, the address driver power measuring circuit 5 may count the number of times of selective discharge (per field display period) generated in an addressing stage Wc, later described, based on the pixel driving data $GD_{11}$–$GD_{nm}$, and provides the number of times of selective discharges as the power consumption of the address driver 6.

The drive control circuit 2 supplies the selector 36 in the data cconverter 30 with the address power limit signal APC at logical level "0" when the power consumption indicated by the address power information signal API is smaller than predetermined power, and at logical level "1" when the power consumption is larger than the predetermined power. The drive control circuit 2 further supplies each of the address driver 6, first sustain driver 7 and second sustain driver 8 with a variety of timing signals for driving and controlling the PDP 10 in accordance with a light emission driving format illustrated in FIG. 6.

Figure 6:
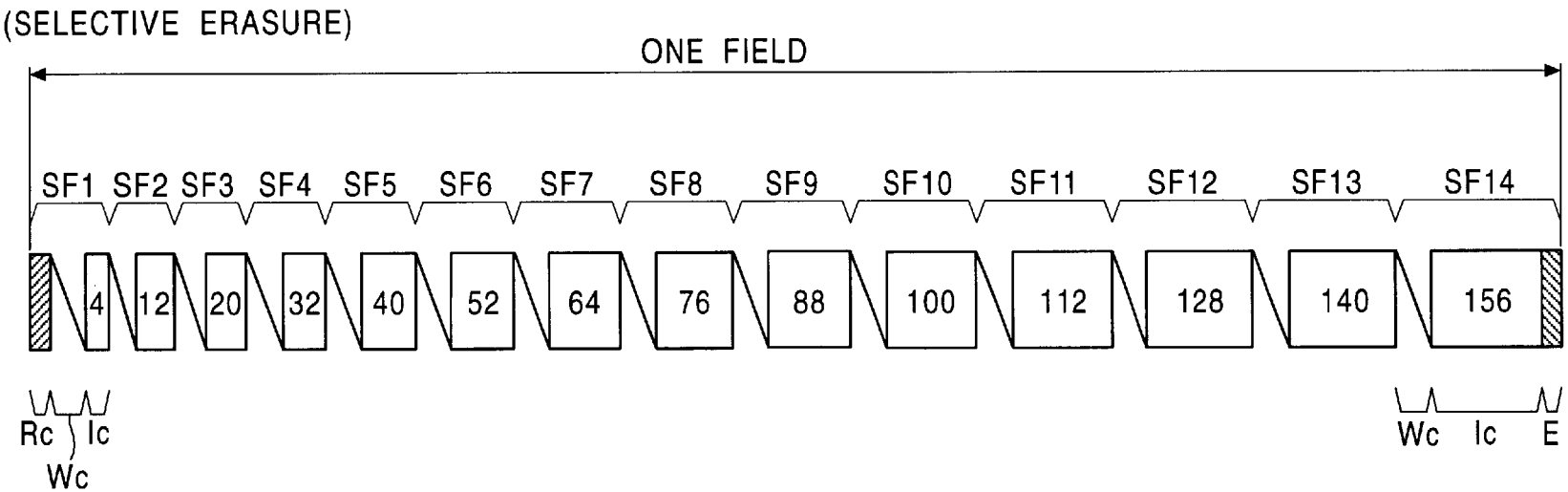
FIG. 6 is a diagram illustrating an exemplary light emission driving format for use in driving a PDP 10 when employing a selective erasure addressing method.

In the light emission driving format illustrated in FIG. 6, one field display period is divided into 14 subfields SF1–SF14, and the PDP 10 is driven in each subfield. In this case, an addressing stage Wc and a light emission sustain stage Ic are performed respectively in each of the subfields, a selective initialization stage SRc is performed only in the first subfield SF1, and an erasure stage E is performed only in the last subfield SF14.

Figure 7:
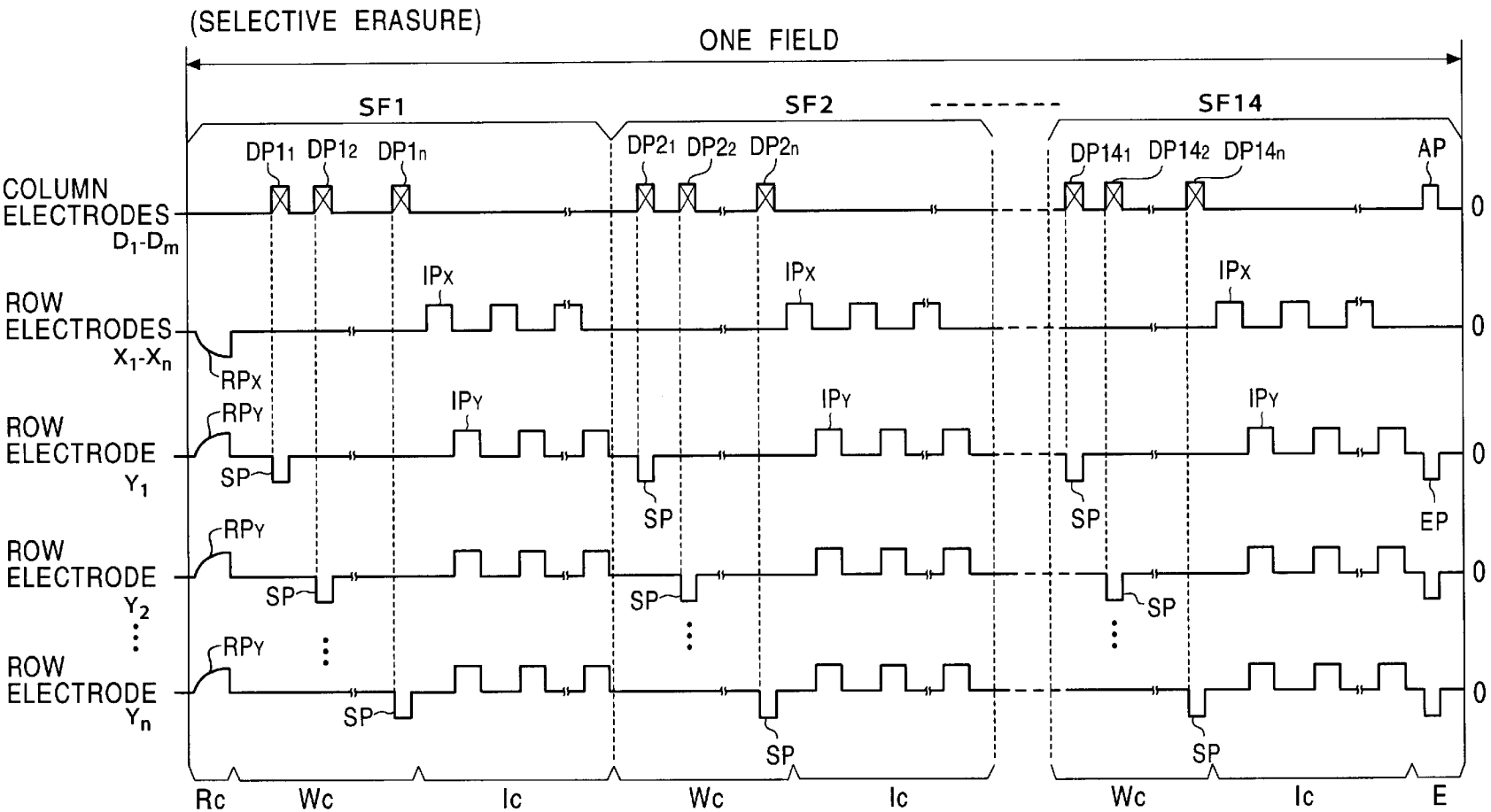
FIG. 7 is a diagram illustrating a variety of driving pulses applied to the PDP 10 in one field period, and application timings therefor.

FIG. 7 is a diagram showing a variety of driving pulses applied by each of the address driver 6, first sustain driver 7 and second sustain driver 8 to the PDP 10 in each of the foregoing simultaneous reset stage Rc, addressing stage Wc, light emission sustain stage Ic, and erasure stage E, and timings at which the driving pulses are applied.

First, in the simultaneous reset stage Rc performed only in the subfield SF1, each of the first sustain driver 7 and second sustain driver 8 simultaneously applies reset pulses $RP_X$, $RP_Y$ having waveforms as illustrated in FIG. 7 to the row electrodes $X_1$–$X_N$ and $Y_1$–$Y_N$ of the PDP 10, respectively. In response to the simultaneously applied reset pulses $RP_X$ and $RP_Y$, all discharge cells in the PDP 10 are discharged or reset. Immediately after the reset discharge, a predetermined amount of wall charge is uniformly formed within the respective discharge cells. In this way, all the discharge cells are initialized to the "lit discharge cell state."

Next, in the addressing stage Wc in each subfield, the address driver 6 generates a pixel data pulse having a voltage corresponding to a logical level of each of pixel driving data bits DB in one line portion (m) supplied from the memory 4, and applies the column electrodes $D_1$–$D_m$ with a pixel data pulse group DP comprised of m pixel data pulses. Specifically, in the addressing stage Wc in the subfield SF1, the address driver 6 sequentially applies the column electrodes $D_1$–$D_m$ with a pixel data pulse group DP1 having a voltage corresponding to each of the pixel driving data bits $DB1_1$–$DB_{nm}$, display line by display line ($DP1_1$, $DP1_2$, $DP1_3$, . . . , $DP1_n$). Next, in the addressing stage Wc in the subfield SF2, the address driver 6 sequentially applies the column electrodes $D_1$–$D_m$ with a pixel data pulse group DP2 having a voltage corresponding to each of the pixel driving data bits $DB2_{11}$–$DB2_{nm}$, display line by display line ($DP2_1$, $DP2_2$, $DP2_3$, . . . , $DP2_n$). Similarly, in the addressing stage Wc in each of the subfields SF3–SF14, the address driver 6 sequentially applies the column electrodes $D_1$–$D_m$ with a pixel data pulse group DP(DP3–DP14)2 having a voltage corresponding to each of the pixel driving data bits DB ($DB3_{11\text{-}nm}$–$DB14_{11\text{-}nm}$), display line by display line. The address driver 6 generates the pixel data pulse at a low voltage (zero volt) when the pixel driving data bit DB is at logical level "0" and the pixel data pulse at a high voltage when the pixel driving data bit DB is at logical level "1."

Further, in each addressing stage Wc, the second sustain driver 8 generates a scanning pulse SP as illustrated in FIG. 7 and sequentially applies the scanning pulse SP to the row electrodes $Y_1$–$Y_n$ at the same timing at which each pixel data pulse group DP is applied. In this case, a discharge selectively occurs only in discharge cells at intersections of the row electrodes applied with the scanning pulse SP with the column electrodes applied with the pixel data pulse at the high voltage (selective erasure discharge), thereby erasing the wall charges which have remained in these discharge cells. Here, a discharge cell which loses the wall charge due to the selective erasure discharge is set to the "unlit discharge cell state." On the other hand, a discharge cell which escapes from the selective erasure discharge has the wall charge, generated in the simultaneous reset stage Rc, remaining therein, so that this discharge cell is set to the "lit discharge cell state."

In other words, the addressing stage Wc is executed to set each of the discharge cells either to the "lit discharge cell state" in which the discharge cell can discharge (sustain discharge) in the light emission sustain stage Ic, or to the "unlit discharge cell state" in which the discharge cell does not discharge in the light emission sustain stage Ic.

Next, in the light emission sustain stage Ic performed in each subfield, the first sustain driver 7 and second sustain driver 8 repeatedly apply the row electrodes $X_1$–$X_n$ and $Y_1$–$Y_n$ alternately with sustain pulses $IP_X$ and $IP_Y$ as illustrated in FIG. 7. The number of times the sustain pulses IP are applied in the light emission sustaining stage Ic is different from one subfield to another, as illustrated in FIG. 6.

Specifically, assuming that the number of times of application in the light emission sustain stage Ic in the subfield SF1 is "1,"

SF1: 4

SF2: 12

SF3: 20

SF4: 32

SF5: 40

SF6: 52

SF7: 64

SF8: 76

SF9: 88

SF10: 100

SF11: 112

SF12: 128

SF13: 140

SF14: 156

Then, only discharge cells in which the wall charges remain, i.e., the discharge cells which have been set to the "lit discharge cell stage"in the addressing stage Wc discharge to sustain light emission each time they are applied with the sustain pulses $IP_X$, $IP_Y$, and sustain the light emitting state associated with the sustain discharge by the number of times allocated thereto in each subfield. In this case, whether or not each discharge cell is set to the "lit discharge cell state" in the addressing stage Wc depends on the pixel driving data GD which is generated based on the input video signal. Here, the 14-bit pixel driving data GD can take 15 patterns as shown in FIG. 4 or FIG. 5.

The pixel driving data GD shown in FIG. 4 and FIG. 5 have its first bit at logical level "0" except for those corresponding to the multi-gradation pixel data $PD_S$ at "0000" representative of a minimum luminance. Then, a number of bits subsequent to the first bit, corresponding to a luminance level to be represented, are at logical level "0" in continuation. In this case, in the pixel driving data GD shown in FIG. 5, except for a GD pattern corresponding to the multi-gradation pixel data $PD_S$ at "1110" representative of a maximum luminance, only the next bit digit is at logical level "1" after the continuation of the logical level "0," and each of bits subsequent thereto is again at logical level "0" in continuation. On the other hand, in the pixel driving data GD shown in FIG. 4, after the continuation of the logical level "0," each of bits subsequent to the next bit digit is at logical level "1" in continuation.

According to the driving method using the pixel driving data GD shown in FIGS. 4 and 5, the selective erasure discharge is generated only in the addressing stages Wc of the subfields indicated by black circles within FIGS. 4 and 5. Specifically, the wall charges formed in all discharge cells in the simultaneous reset stage Rc remain until the selective erasure discharge is generated, and the sustain discharge is sequentially generated in the light emission sustain stage Ic in each of intervening subfields. Then, as the selective erasure discharge is generated in the subfields indicated by the black circles in FIGS. 4 and 5, the wall charges remaining the discharge cells are erased to cause the discharge cells to transition to the "unlit discharge cell state" which is sustained until the last subfield SF14. Therefore, each discharge cell is maintained in the "lit discharge cell state" until the addressing stage Wc (indicated by a black circle) in which the selective erasure discharge is first generated in one field period, and sequentially emits light in the light emission sustain stage Ic (indicated by a white circle) in each of the intervening subfields.

Therefore, according to 15 patterns of pixel driving data GD as shown in FIG. 4 or 5, an intermediate display luminance representation can be provided at 15 gradation levels which have visual light emission luminance in the following ratio:

{0, 4, 16, 36, 68, 108, 160, 224, 300, 388, 488, 600, 728, 868, 1024}.

Here, according to the driving method using the pixel driving data $GD_b$ shown in FIG. 5, the number of times of selective erasure discharges generated in one field period is once at most. This is because the wall charges can be formed only in the simultaneous reset stage Rc in the subfield SF1 within one field period, so that if the selective erasure discharge is generated once, the discharge cells can be maintained in the "unlit discharge cell state" from then on. However, if the selective erasure discharge is not correctly generated, the wall charges remain in the discharge cells, so that an unwanted sustain discharge will be generated in the subsequent light emission sustain stage Ic. Therefore, the driving method using the pixel driving data $GD_a$ shown in FIG. 4 sequentially generates the selective erasure discharges as indicated by black circles in the addressing stage Wc in each of subfields after continuous light emission as indicated by white circles in FIG. 4. According to this driving method, even if the first selective erasure discharge is not successful and therefore fails to fully extinguish the wall charges in the discharge cells, the wall charges can be extinguished by the second and subsequent selective erasure discharges, thereby making it possible to prevent a degraded display due to erroneous discharges.

In this case, the drive control circuit 2 executes either the driving method shown in FIG. 4 or the driving method shown in FIG. 5 based on the address power information signal API indicative of the power consumption of the address driver 6, as measured by the address driver power measuring circuit 5. Specifically, the drive control circuit 2 supplies the selector 36 in the data cconverter 30 with the address power limit signal APC at logical level "0" when the current power consumption of the address driver 6 indicated by the address power information signal API is smaller than predetermined power. Consequently, the pixel driving data $GD_a$ as shown in FIG. 4 is supplied to the memory 4, so that the driving in accordance with FIGS. 6 and 7 is performed based on this pixel driving data $GD_a$.

In other words, when the address driver 6 consumes relatively small power, the wall charges in the discharge cells are extinguished without fail by repeating the selective erasure discharges as indicated by black circles in FIG. 4 to perform the driving for preventing a degraded display due to erroneous discharges.

On the other hand, the drive control circuit 2 supplies the selector 36 in the data cconverter 30 with the address power limit signal APC at logical level "1" when the current power consumption of the address driver 6 indicated by the address power information signal API is larger than the predetermined power. Consequently, the pixel driving data $GD_b$ as shown in FIG. 5 is supplied to the memory 4, so that the driving in accordance with FIGS. 6 and 7 is performed based on the pixel driving data $GD_b$.

In other words, when the address driver 6 consumes relatively large power, the number of times of selective erasure discharges performed in one field period is limited to one or less to restrict the power consumption caused by the selective erasure discharge. In this way, the power consumed by the address driver 6 is saved.

The foregoing embodiment has been described in terms with a so-called selective erasure addressing method which is employed as a method of setting each discharge cell in the addressing stage Wc, wherein the wall charges have been previously formed in all discharge cells, and the wall charges are selectively erased in accordance with pixel data.

However, the present invention can be applied as well to a so-called selective write addressing method which is employed to selectively form a wall charge in each discharge cell in accordance with pixel data.

Figure 8:
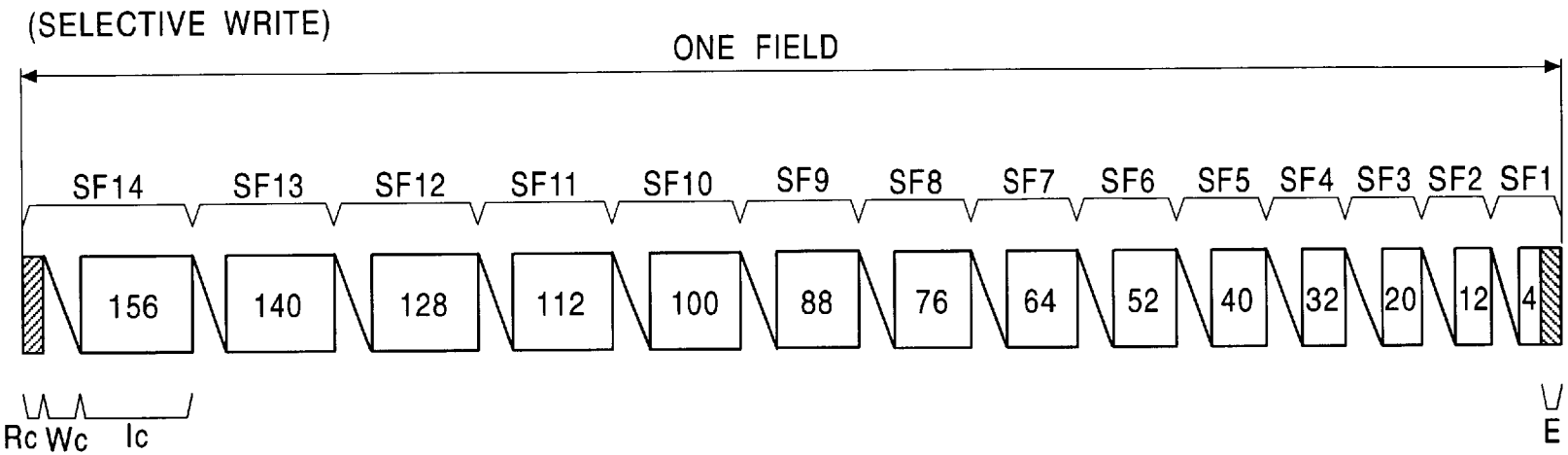
FIG. 8 is a diagram illustrating an exemplary light emission driving format for use in driving the PDP 10 when employing a selective write addressing method.

FIG. 8 illustrates a light emission driving format for use in the drive control circuit 2 when the selective write addressing method is employed. FIG. 9 shows a conversion table for use in the second data converting circuit 34 when the selective write addressing method is employed, and a driving pattern based on pixel driving data $GD_a$ generated by the conversion table. FIG. 10 shows a conversion table for use in the second data converting circuit 35 when the selective write addressing method is employed, and a driving pattern based on pixel driving data $GD_b$ generated by the conversion table.

When the selective write addressing method is employed, a reset discharge is generated in all discharge cells in the simultaneous reset stage Rc in the first subfield SF14 as illustrated in FIG. 8 to extinguish wall charges remaining in all the discharge cells. Then, in the addressing stage Wc in each of the subfields SF14–SF1, each discharge cell is selectively discharged based on the pixel driving data GD shown in FIG. 9 or 10 (selective write discharge). In this case, in a discharge cell in which the selective write discharge is generated, a wall charge is formed within the discharge cell, so that this discharge cell is set to the "lit discharge cell state." On the other hand, in a discharge cell in which no selective write discharge is generated, no wall charge is formed, so that this discharge cell is set to the "unlit discharge cell state." Then, in the light emission sustain stage Ic in each of the subfields SF14–F1, only those discharge cells which have been set to the "lit discharge cell state" repeatedly discharge the number of times described in FIG. 8 to sustain the light emission state associated with the sustain discharge.

In this case, the drive control circuit 2 executes either the driving method shown in FIG. 9 or the driving method shown in FIG. 10 based on the address power information signal API indicative of the power consumption of the address driver 6, as measured by the address driver power measuring circuit 5. Specifically, the drive control circuit 2 supplies the selector 36 in the data cconverter 30 with the address power limit signal APC at logical level "0" when the current power consumption of the address driver 6 indicated by the address power information signal API is smaller than predetermined power. Consequently, the pixel driving data $GD_a$ as shown in FIG. 9 is supplied to the memory 4, so that the driving in accordance with FIG. 8 is performed based on the pixel driving data $GD_a$.

In other words, when the address driver 6 consumes relatively small power, the selective write discharge is continuously generated in the addressing stage Wc in each subfield corresponding to a luminance level to be represented, as indicated by triangles in FIG. 9. Then, the sustain discharge is generated the number of times corresponding to each subfield indicated by a triangle in FIG. 9 in the light emission sustain stage Ic in that subfield. This driving results in an intermediate luminance display at 15 levels:

{0, 1, 4, 9, 17, 27, 40, 56, 75, 97, 122, 150, 182, 217, 255} in accordance with the total number of times the sustain discharge is generated in one field period.

In this case, the wall charges are formed without fail in the discharge cells by repeating the selective write discharge in one field period as indicated by triangles in FIG. 9, to perform the driving for preventing a degraded display caused by erroneous discharges.

On the other hand, the drive control circuit 2 supplies the selector 36 in the data converter 30 with the address power limit signal APC at logical level "1" when the current power consumption of the address driver 6 indicated by the address power information signal API is larger than the predetermined power. Consequently, the pixel driving data $GD_b$ as shown in FIG. 10 is supplied to the memory 4, so that the driving in accordance with FIG. 8 is performed based on the pixel driving data $GD_b$.

In other words, when the address driver 6 consumes relatively large power, the number of times of selective write discharges performed in one field period is limited to one or less. When the selective write addressing method is employed, stages in which the wall charges are extinguished in the discharge cells are only the simultaneous reset stage Rc in the first subfield SF14, and the erasure stage E in the last subfield SF1. Therefore, when the selective write discharge is generated only once in the addressing stage Wc in a subfield indicated by a black circle in FIG. 10, the discharge cells can be maintained in the "lit discharge cell state" even without generating the selective write discharge in the addressing stage Wc in each of subsequent subfields. Thus, the sustain discharge is generated the number of times corresponding to each subfield indicated by black circles and white circles in FIG. 10 in the light emission sustain stage Ic of the subfield. This driving results in an intermediate luminance display at 15 levels:

{0, 1, 4, 9, 17, 27, 40, 56, 75, 97, 122, 150, 182, 217, 255} in accordance with the total number of times of the sustain discharges generated in one field period, as is the case with FIG. 9.

It should be noted however that in the driving pattern shown in FIG. 10, the number of times the selective write discharge is generated in one field period is limited to one or less, so that the power consumption caused by the selective write discharge is reduced as compared with that caused by the driving pattern shown in FIG. 9.

Also, in the foregoing embodiment, when the current power consumption of the address driver 6 is large, the number of times the selective erasure (or write) discharge is performed in one field period is limited to one or less, as shown in FIG. 5 (or FIG. 10). The present invention, however, is not limited to this driving method. In essence, when the current power consumption of the address driver 6 is large, the number of times of the selective erasure (or write) discharges generated continuously in one field may be reduced as compared with the driving pattern shown in FIG. 4 (or FIG. 9).

Alternatively, instead of reducing the number of times the selective erasure (or write) discharge is performed continuously in one field in the foregoing manner, the number of subfields performed in one field period may be reduced.

Figures 11A, 11B:
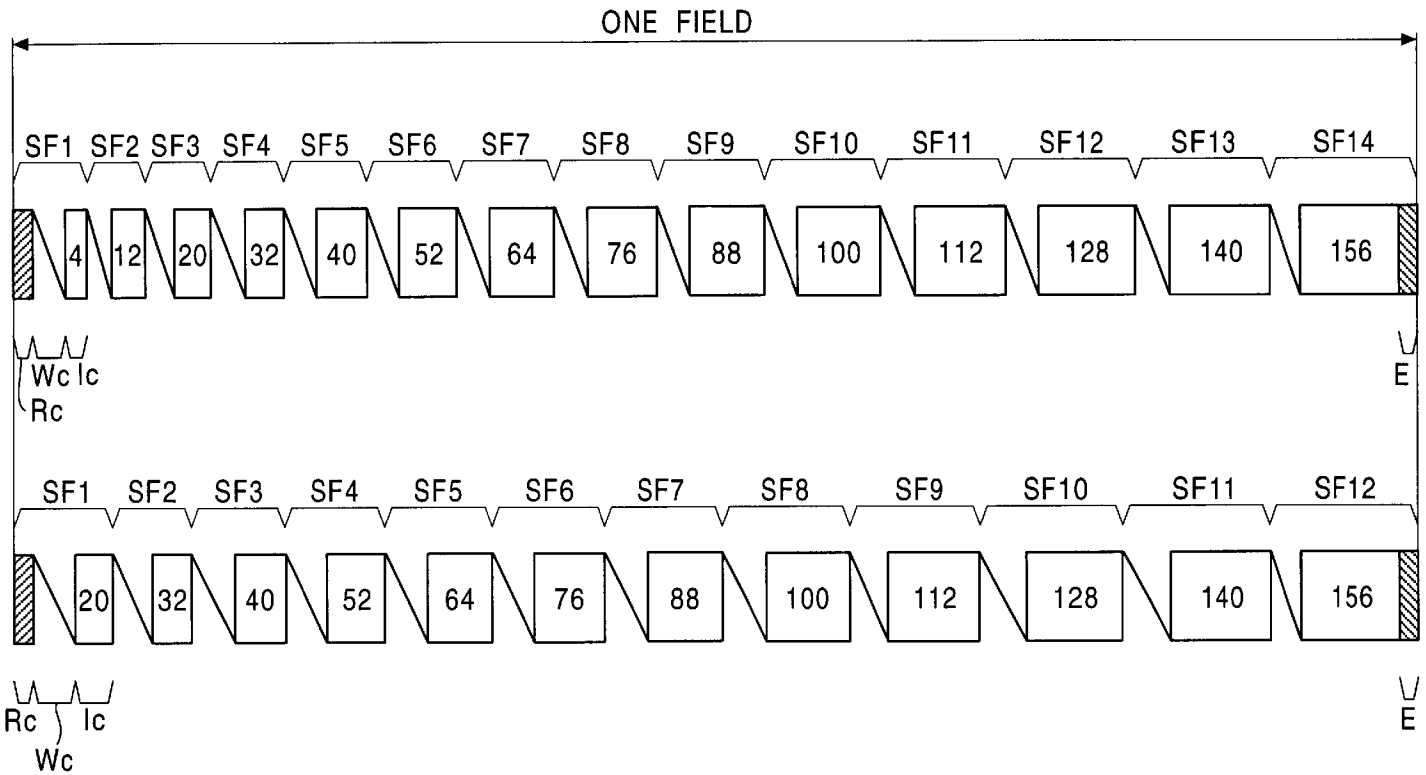
FIGS. 11A and 11B are diagrams illustrating light emission driving formats according to another embodiment of the present invention.

FIGS. 11A and 11B illustrate exemplary light emission driving formats which are created in view of the foregoing aspect.

Specifically, when the current power consumption of the address driver 6 is smaller than predetermined power, the drive control circuit 2 selects a gradation driving format with 14 subfields SF1–SF14 as shown in FIG. 11A. On the other hand, when the current power consumption of the address driver 6 is larger than the predetermined power, the drive control circuit 2 selects a gradation driving format with 12 subfields SF1–SF12 as shown in FIG. 11B. Thus, when the current power consumption of the address driver 6 is relatively large, the number of subfields performed in one field period is reduced from 14 to 12, resulting in a corresponding reduction in the number of times the selective discharge is generated in the addressing stage Wc. Consequently, since the number of times the selective discharge is generated in one field is reduced, the power consumption caused by the selective discharge is saved in the address driver 6.

In the foregoing embodiment, the number of times the selective discharge is generated in one field period is switch at two stages, as in the driving pattern shown in FIG. 4 and the driving pattern shown in FIG. 5, in accordance with the current power consumption of the address driver 6. The present invention however is not limited to this driving method. In essence, the number of times the selective discharge is repeatedly generated in one field period may be switched at three or more stages in accordance with the current power consumption of the address driver 6.

As described above in detail, in the driving method of a plasma display panel and plasma display apparatus according to the present invention, the number of times the selective discharge is generated in one field period is changed in accordance with the current power consumption of the address driver which generates the pixel data pulse and applies the PDP with the pixel data pulse.

It is therefore possible, according to the present invention, to reduce the number of times the selective discharge is generated in one field period when the current power consumption of the address driver is relatively large to save the power consumption caused by the selective discharge.

This application is based on Japanse Patent application No. 2001-172389 which is herein incorporated by reference.

What is claimed is:

1. A plasma display panel driving method for driving a plasma display panel including a plurality of discharge cells carrying display pixels based on a video signal, said method comprising:

an addressing stage for generating a selective discharge at least once for setting each of said discharge cells to a lit discharge cell state or an unlit discharge cell stage in accordance with pixel data based on said video signal; and a light emission sustain stage for causing only said discharge cell in said lit discharge cell state to repeatedly discharge, wherein the number of times of said selective discharges generated in said addressing stage is changed in accordance with power consumption associated with said selective discharge.

2. A plasma display panel driving method according to claim 1, wherein the number of times said selective discharge is generated in said addressing stage is reduced when the power consumption is large as compared with when the power consumption is small.

3. A plasma display panel driving method according to claim 1, wherein the number of times said selective discharge is generated in said addressing stage is set to one or less when the power consumption is large.

4. A plasma display panel driving method according to claim 1, wherein the number of said discharge cells set to either said lit discharge cell state or said unlit discharge cell stage based on said pixel data is counted, and the counted number is used as an index indicative of the power consumption.

5. A plasma display panel driving method according to claim 1, wherein the power consumed by said selective discharge is power consumed in an address driver which generates a pixel data pulse for generating said selective discharge and applies the pixel data pulse to each of said discharge cells.

6. A plasma display panel driving method for driving a plasma display panel including a plurality of cells carrying display pixels in each of a plurality of subfields constituting one field of a video signal, wherein:

each of said subfield includes an addressing stage for selectively generating a selective discharge for setting each of said discharge cells to a lit discharge cell state or an unlit discharge cell stage in accordance with pixel data based on said video signal, and a light emission sustain stage for causing only said discharge cell in said lit discharge cell state to repeatedly discharge, and said selective discharge is repeatedly generated in said addressing stage only in each of one subfield in each of said plurality of subfields constituting said one field and subfields subsequent to said one subfield and consecutive to each other when power consumption associated with said selective discharge is small, and the number of times said selective discharge is generated in a subfield subsequent to said one subfield is reduced when the power consumption is large.

7. A plasma display panel driving method for driving a plasma display panel including a plurality of cells carrying display pixels in a plurality of subfields constituting one field of a video signal, wherein:

each of said subfield includes an addressing stage for selectively generating a selective discharge for setting each of said discharge cells to a lit discharge cell state or an unlit discharge cell stage in accordance with pixel data based on said video signal, and a light emission sustain stage for causing only said discharge cell in said lit discharge cell state to repeatedly discharge, and the number of said subfields constituting said one field is smaller when the power consumption associated with said selective discharge is large than when the power consumption is small.

8. A plasma display apparatus having a plurality of row electrode pairs corresponding to display lines and a plurality of column electrodes arranged to intersect with each of said row electrode pairs, and discharge cells each formed at each of intersections of said row electrode pairs and said column electrodes for carrying a pixel, wherein one field display period includes N subfields each comprised of an addressing period and a light emission sustain period for driving said plasma display panel, said plasma display apparatus comprising:

an address driver for generating a pixel data pulse for selectively discharging said discharge cells in said addressing period of one subfield in said N subfields and each of subfields subsequent to said one subfield and consecutive to each other to set said discharge cell to a lit discharge cell state or an unlit discharge cell stage, and applying said pixel data pulse to said column electrodes;

a sustain driver for repeatedly applying a sustain pulse to said row electrodes in said light emission sustain period in each of said subfields to repeatedly discharge only said discharge cells set in said lit discharge state to sustain light emission;

address driver power measuring part for measuring power consumed by said address driver; and address power control part for changing the number of times said selective discharge is generated in a subfield subsequent to said one subfield in accordance with the power consumption.

9. A plasma display apparatus according to claim 8, wherein said address power control means reduces the number of times of said selective discharges generated in the subfield subsequent to said one subfield when the power consumption is large as compared with when the power consumption is small.

10. A plasma display apparatus according to claim 8, wherein said address power control means generates said selective discharge only in said addressing period in said one subfield when the power consumption is large.

* * * * *

UNITED STATES PATENT AND TRADEMARK OFFICE

CERTIFICATE OF CORRECTION

PATENT NO. : 6,816,135 B2
DATED : November 9, 2004
INVENTOR(S) : Shigeo Ide et al.

It is certified that error appears in the above-identified patent and that said Letters Patent is hereby corrected as shown below:

Column 11,
Lines 15, 36-37 and 53, “unlit discharge cell stage” should read -- unlit dicharge cell state --;

Column 12,
Lines 12 and 35-36, “unlit discharge cell stage” should read -- unlit discharge cell state --.

Signed and Sealed this

Twentieth Day of September, 2005

JON W. DUDAS
*Director of the United States Patent and Trademark Office*